US007115045B2

(12) United States Patent
Horwood et al.

(10) Patent No.: US 7,115,045 B2
(45) **Date of Patent: *Oct. 3, 2006**

(54) HYBRID GOLD CLUB SHAFT SET

(75) Inventors: Graeme Horwood, Germantown, TN (US); Scott Cokeing, Eads, TN (US); Kenney Rump, Memphis, TN (US)

(73) Assignee: True Temper Sports, Inc., Memphis, TN (US)

( * ) Notice: Subject to any disclaimer, the term of this patent is extended or adjusted under 35 U.S.C. 154(b) by 193 days.

This patent is subject to a terminal disclaimer.

(21) Appl. No.: 10/645,995

(22) Filed: Aug. 22, 2003

(65) Prior Publication Data

US 2004/0106463 A1 Jun. 3, 2004

Related U.S. Application Data

(63) Continuation-in-part of application No. 10/228,633, filed on Aug. 27, 2002, now Pat. No. 6,729,970.

(51) Int. Cl.
*A63B 53/10* (2006.01)
*A63B 53/12* (2006.01)

(52) U.S. Cl. ..... 473/289; 473/320

(58) Field of Classification Search ..... 473/289, 473/320, 321

See application file for complete search history.

(56) References Cited

U.S. PATENT DOCUMENTS

| | | | | |
|---|---|---|---|---|
| 4,165,874 A | | 8/1979 | Lezatte et al. | |
| 5,014,992 A | | 5/1991 | McCallister | |
| 5,093,162 A | | 3/1992 | Fenton et al. | |
| 5,192,073 A | * | 3/1993 | Iwanaga et al. | 473/289 |
| 5,193,806 A | | 3/1993 | Burkly | |
| 5,253,867 A | | 10/1993 | Gafner | |
| 5,344,149 A | | 9/1994 | Miller | |
| 5,509,659 A | | 4/1996 | Igarashi | |
| 5,542,665 A | | 8/1996 | Levocz et al. | |
| 5,879,241 A | | 3/1999 | Cook et al. | |
| D444,526 S | | 7/2001 | Adams et al. | |
| 6,343,999 B1 | | 2/2002 | Murtland et al. | |
| 6,348,010 B1 | | 2/2002 | Doolen | |
| 2002/0025860 A1 | | 2/2002 | Sosin | |

FOREIGN PATENT DOCUMENTS

| | | |
|---|---|---|
| EP | 1 084 737 A2 | 3/2000 |
| JP | 11-192328 | 7/1999 |
| JP | 2001-120697 | 5/2001 |

* cited by examiner

*Primary Examiner*—Stephen Blau
(74) *Attorney, Agent, or Firm*—Harness, Dickey & Pierce, P.L.C.

(57) ABSTRACT

A hybrid golf club shaft set is provided that includes at least two of the group including a composite shaft subset including shafts formed entirely of composite, a composite/metal shaft subset including shafts formed of composite/metal combination shafts, and a metal shaft subset including shafts formed entirely of metal.

7 Claims, 4 Drawing Sheets

HYBRID GOLD CLUB SHAFT SET

FIELD OF THE INVENTION

The present invention relates to golf club sets and, more particularly, to a golf club set having shafts formed of different materials corresponding to the length of the shaft and/or the loft of the club head.

BACKGROUND OF THE INVENTION

Two types of shafts dominate the golf club shaft market. The first type of shaft is made entirely of metal such as high strength alloy steel. The second type of shaft is made entirely of a composite such as graphite.

Metal shafts are generally regarded as being relatively heavy but provide high torsional stiffness. This results in a playability which yields accurate ball control and good feel but may limit club head speed and hence distance. It can also be made difficult to obtain a high tip flexibility with metal shafts compared to composite shafts which can compromise ball trajectory.

Composite shafts are generally regarded as being relatively light with more flexible tips which can result in a playability which yields higher club head speed and more distance as well as a higher ball trajectory. However, because composite shafts are not very torsionally stiff, composite shafts are also regarded as being somewhat limited in terms of accurate ball control and feel.

To take advantage of the separate benefits of metal and composite shafts while minimizing their deficiencies, a multiple material golf club shaft has recently been introduced to the market. A multiple material shaft is made partially of metal and partially of composite. In other words, a first portion of the shaft is formed of metal, a second portion of the shaft is made of composite, and the two portions are coupled together.

Multiple material shafts are generally regarded as being light weight and resistant to torque. This enables the generation of more club head speed than an all metal shaft and with better accuracy than an all composite shaft. Because club head speed is highly desirable for long irons with low lofts, and accuracy is highly desirable for short irons with high lofts, and a compromise of club head speed and accuracy is highly desirable for middle irons with medium lofts, it would be desirable to provide a golf club set which maximizes these shaft characteristics across the set.

SUMMARY OF THE INVENTION

In a first embodiment of the present invention, a hybrid golf club shaft set is provided that includes a composite shaft subset including shafts formed entirely of composite, a composite/metal shaft subset including shafts formed of composite/metal combination shafts, and a metal shaft subset including shafts formed entirely of metal. The composite shaft subset preferably includes the long irons with the lowest lofts such as the two, three, and four iron shafts. The composite/metal shaft subset preferably includes the middle irons with medium lofts such as the five, six, and seven iron shafts. The metal shaft subset preferably includes the short irons with the highest lofts such as the eight, nine, and wedge shafts.

By providing the proposed shaft set, the shaft style most generally regarded as providing the greatest club head speed is provided in the regime where distance is extremely critical. Likewise, the shaft style most generally regarded as providing the greatest torsional resistance is provided in the regime where accuracy is extremely critical. Finally, the shaft style generally regarded as providing the greatest balance of distance with accuracy is provided in the regime where distance and accuracy are equally critical.

In a second embodiment of the present invention, a hybrid golf club shaft set is provided that includes only shaft subsets selected from the group including a composite shaft subset, a composite/metal shaft subset, and a metal shaft subset. By providing the proposed shaft set, a golfer with more distance than accuracy concerns can employ a shaft set including a composite shaft subset and a composite/metal shaft subset. This shaft set allows the golfer to maximize club head speed across a broader spectrum than a shaft set including a metal shaft subset. Similarly, a golfer with more accuracy than distance concerns can employ a shaft set including a composite/metal shaft subset and a metal shaft subset. This shaft subset allows the golfer to maximize accuracy across a broader spectrum than a shaft set including a composite shaft subset.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 illustrates an array of golf clubs forming a set having two separate shaft subsets in accordance with the teachings of the present invention.

DETAILED DESCRIPTION OF THE PREFERRED EMBODIMENTS

The following description of the preferred embodiments is merely exemplary in nature and is in no way intended to limit the invention, its application, or uses.

The present invention is directed towards a hybrid golf club shaft set. This set includes one or more shafts made entirely of composite, one or more shafts made of a composite/metal combination, and one or more shafts made entirely of metal. Preferably, the long iron regime, which may include any one or more of a one, two, three and four iron, comprises all composite shafts. Such light and flexible shafts provide the user with great distance through the generation of high club head speed and high ball trajectory.

The middle iron regime, which may include any one or more of a five, six, and seven iron, comprises composite/metal combination shafts. Such hybrid shafts provide the user with greater distance than an all metal shaft with greater accuracy than an all composite shaft. The short iron regime, which may include any one or more of an eight, nine, and wedge (including but not limited to a pitching wedge, gap wedge, sand wedge, and lob wedge), comprises all metal shafts. Such heavy and stiff shafts provide the user with great accuracy through the provision of high torsion resistance and good feel. As an alternative, the hybrid golf club shaft set may include only two shaft subsets selected from among shafts made entirely of composite, shafts made of a composite/metal combination, and shafts made entirely of metal.

Figure 1:
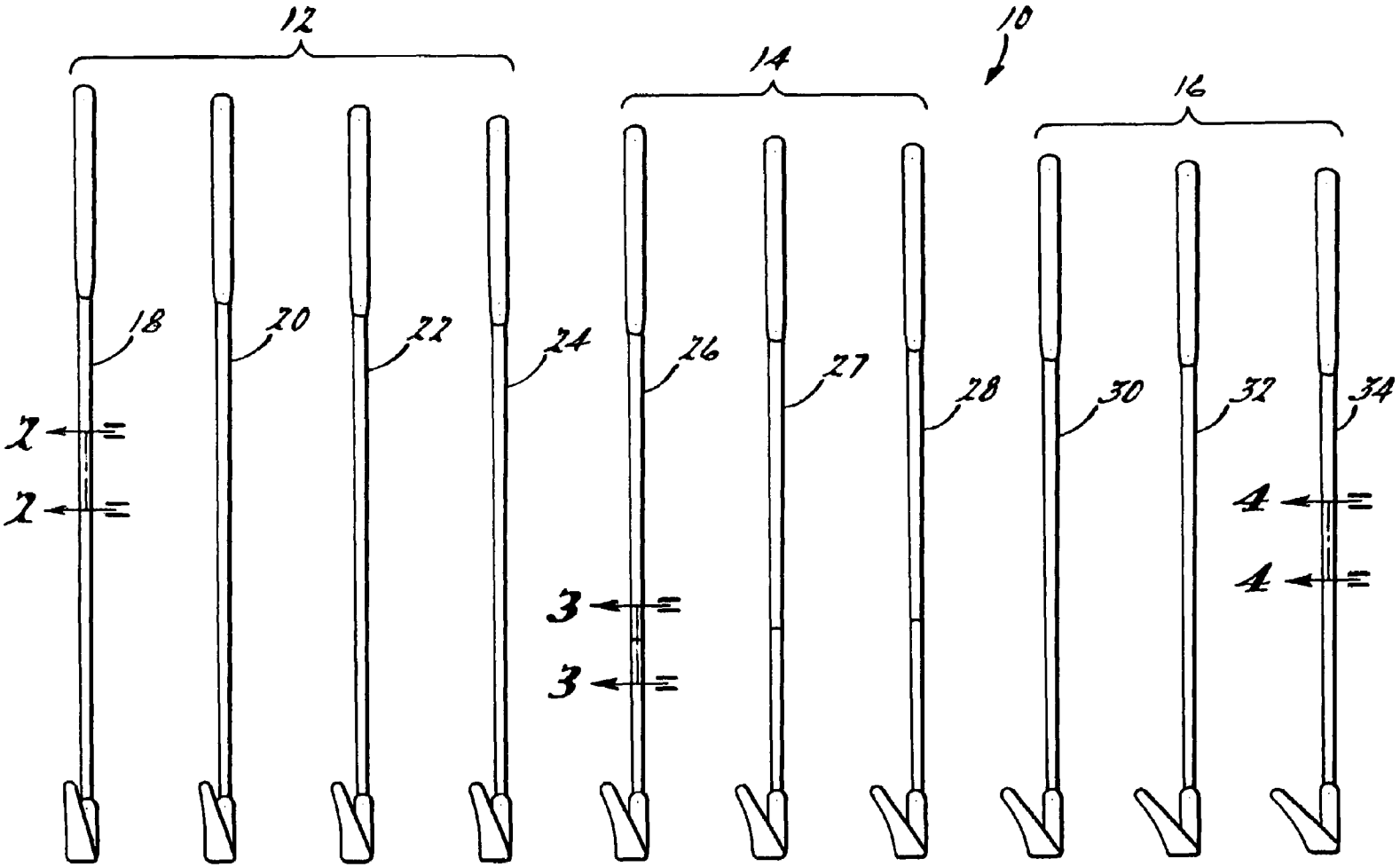
FIG. 1 illustrates an array of golf clubs forming a set having three separate shaft subsets in each of three regimes in accordance with the teachings of the present invention.

Turning now to the drawings, FIG. 1 illustrates a golf club set 10 incorporating the teachings of the present invention. This set 10 includes a first shaft subset 12, a second shaft subset 14, and a third shaft subset 16. The first shaft subset 12 includes shafts formed entirely of composite such as graphite. The second shaft subset 14 includes shafts formed of composite/metal combinations such as graphite butt sections coupled to steel tips. The third shaft subset 16 includes shafts formed entirely of metal such as steel.

The first shaft subset 12 preferably includes the long iron regime. For example, the first shaft subset 12 may include any one or more of a one iron 18, a two iron 20, a three iron 22, and/or a four iron 24. The second shaft subset 14 preferably includes the middle iron regime. For example, the second shaft subset 14 may include any one or more of the five iron 26, six iron 27, and/or seven iron 28. The third shaft subset 16 preferably includes the short iron regime. For example, the third shaft subset may include any one or more of the eight iron 30, nine iron 32, and/or wedge 34. Although only one wedge 34 is illustrated, it should be appreciated that any number of wedges could be included in the third shaft subset.

Figure 2:
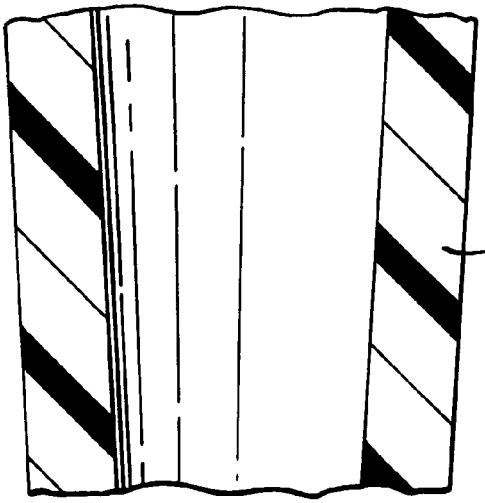
FIG. 2 is a cross sectional view of a shaft of a first shaft subset of the present invention which is made entirely of composite taken along line 2—2 of FIG. 1.

Turning to FIG. 2, a cross sectional view of the one iron shaft 18 is illustrated. The one iron shaft 18 is formed entirely of composite. Although not illustrated, all other members of the first shaft subset 12 (FIG. 1) also include shafts formed entirely of composite. The wall thickness and material lay-up of the shaft 18 (and all other shafts in the first shaft subset 12) are selected to yield the desired swing characteristics of the shaft 18. For example, the shaft weight for the composite shafts may be 70 grams.

Figure 3:
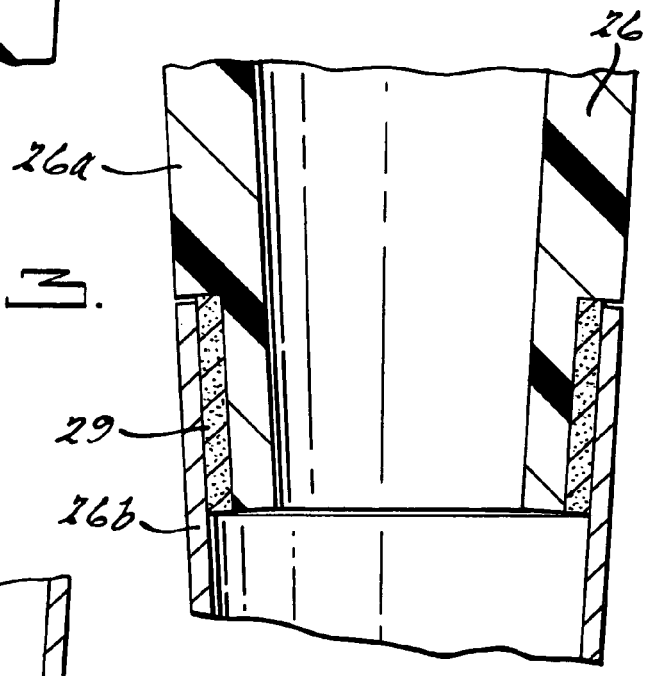
FIG. 3 is a cross sectional view of a shaft of a second shaft subset of the present invention which is made of composite and metal taken along line 3—3 of FIG. 1.

Turning to FIG. 3, a cross sectional view of the five iron shaft 26 is illustrated. The five iron shaft 26 is formed of a composite section 26*a* coupled to a metal section 26*b*. An adhesive 29 is disposed between the two sections 26*a* and 26*b* to secure the two together. Although not illustrated, all other members of the second shaft subset 14 (FIG. 1) also include shafts formed of composite/metal combinations. One embodiment of the composite/metal shaft is describe in U.S. patent application Ser. No. 09/745,001 filed Dec. 21, 2000 which is hereby expressly incorporated by reference herein in its entirety. Another embodiment of the composite/metal shaft is described in U.S. patent application Ser. No. 10/228,392 entitled Golf Club Shaft Set filed Aug. 27, 2002, which is also incorporated by reference herein in its entirety. The materials and dimensions of the shaft 26 (and all other shafts in the second shaft subset 14) are selected to yield desired swing characteristics of the shaft 26. For example, the swing weight for the composite/metal shafts may be 82 grams.

Figure 4:
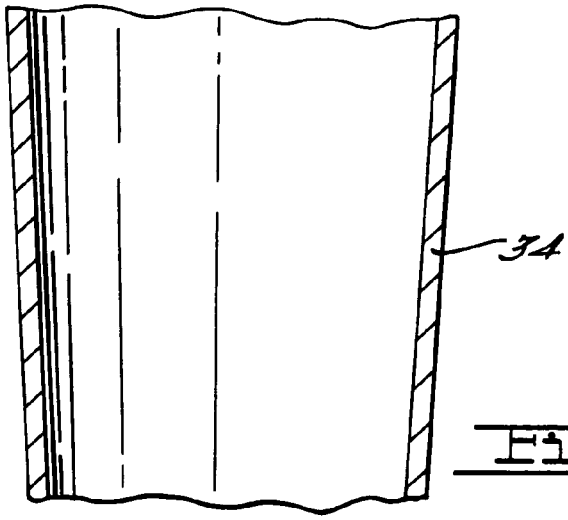
FIG. 4 is a cross sectional view of a shaft of a third shaft subset of the present invention which is made entirely of metal taken along line 4—4 of FIG. 1.

Turning to FIG. 4, a cross sectional view of the wedge shaft 34 is illustrated. The wedge shaft 34 is formed entirely of metal. Although not illustrated, all of the other members of the third shaft subset 16 (FIG. 1) include shafts formed entirely of metal. The wall thickness and material of the shaft 34 (and all other shafts in the third shaft subset 16) are selected to yield the desired swing characteristics of the shaft 34. For example, the shaft weight for the metal shafts may be 94 grams.

Turning again to FIG. 1, the second shaft subset 14 is illustrated as including tip sections which are substantially equal in length. Alternatively, the tip sections may proportionately decrease as the overall shaft lengths decrease. However, in the presently preferred embodiment, the tip section length is inversely proportional to the overall shaft length. As such, as the overall shaft length decreases, the proportionate length of the tip section increases. This provides even greater torsional resistance (and therefore greater accuracy and feel) in each consecutively shorter club where the desire for accuracy increases. A preferred embodiment of such a composite/metal shaft set is described in the above referenced U.S. patent application Ser. No. 10/228,392. For example, the five, six and seven iron composite/metal combination shafts may have 9, 9.5, and 10 inch steel tip sections respectively.

The first, second, and third shaft subsets 12, 14, and 16 may be delineated from one another according to the type of club (e.g., one iron, two iron, etc.) included therein. The subsets may also be delineated from one another by the length of the shafts and/or the lofts of the club heads. These dimensions may be set in absolute terms and/or relative terms. However, it should be appreciated that club numbers, club lengths, and club lofts are not standardized throughout the industry. Recently, there has been a trend towards longer clubs with less loft. The descriptions contained herein are intended to describe the situation as of the filing date of this application.

The following table lists exemplary length and loft ranges for various irons:

| Iron | Length (inches) | Loft (degrees) |
|---|---|---|
| 1 | 39.5–40.5 | 13–17 |
| 2 | 39–40 | 15–19 |
| 3 | 38.5–39.5 | 18–22 |
| 4 | 38–39 | 21–25 |
| 5 | 37.5–38.5 | 24–28 |
| 6 | 37–38 | 28–32 |
| 7 | 36.5–37.5 | 32–36 |
| 8 | 36–37 | 36–40 |
| 9 | 35.5–36.5 | 40–44 |
| PW | 35.25–36.25 | 44–48 |
| GW | 35–36 | 48–52 |
| SW | 35–36 | 53–57 |
| LW | 35–36 | 58–62 |

Based upon the above table, the first shaft subset may be defined as including shafts for the 1, 2, 3, and 4 irons. The first shaft subset 12 may alternatively be defined as including shafts having a length within a first predetermined range such as 37 to 40 inches. The first shaft subset 12 may further be defined as including shafts with a club head loft within a first predetermined range such as such as 15 to 25 degrees.

The second shaft subset 14 may be defined as including shafts for the 5, 6, and 7 irons. The second shaft subset 14 may alternatively be defined as including shafts having a length within a second predetermined range such as 36 to 38 inches. The second shaft subset 14 may further be defined as including shafts with a club head loft within a second predetermined range such 24 to 36 degrees.

The third shaft subset 16 may be defined as including shafts for the 8, 9 and wedges. The third shaft subset 16 may alternatively be defined as including shafts having a length within a third predetermined range such as 35 to 37 inches. The third shaft subset 16 may further be defined as including shafts with a club head loft within a third predetermined range such as 35 to 60 degrees.

In relative terms, the first predetermined range may be defined as including shafts having a length between X and Y inches or a loft between A and B degrees. The second predetermined range may be defined as including shafts having a length between $X–Z_1$ and $Y–Z_2$ inches or a loft between $A+C_1$ and $B+C_2$ degrees, wherein, for example $Z_1=1$, $Z_2=2$, $C_1=10$, and $C_2=12$. The third predetermined range may be defined as including shafts having lengths between $X–Z_3$ and $Y–Z_4$ inches or $A+C_3$ and $B+C_4$ degrees wherein, for example, $Z_3=2$, $Z_4=3$, $C_3=20$, and $C_4=35$.

As can be seen, the first, second, and third predetermined ranges are different but may overlap. The first predetermined length range is greater than the second predetermined length range which is greater than the third predetermined length range. In contrast, the first predetermined loft range is less than the second predetermined loft range which is less than the third predetermined loft range.

Figure 5:
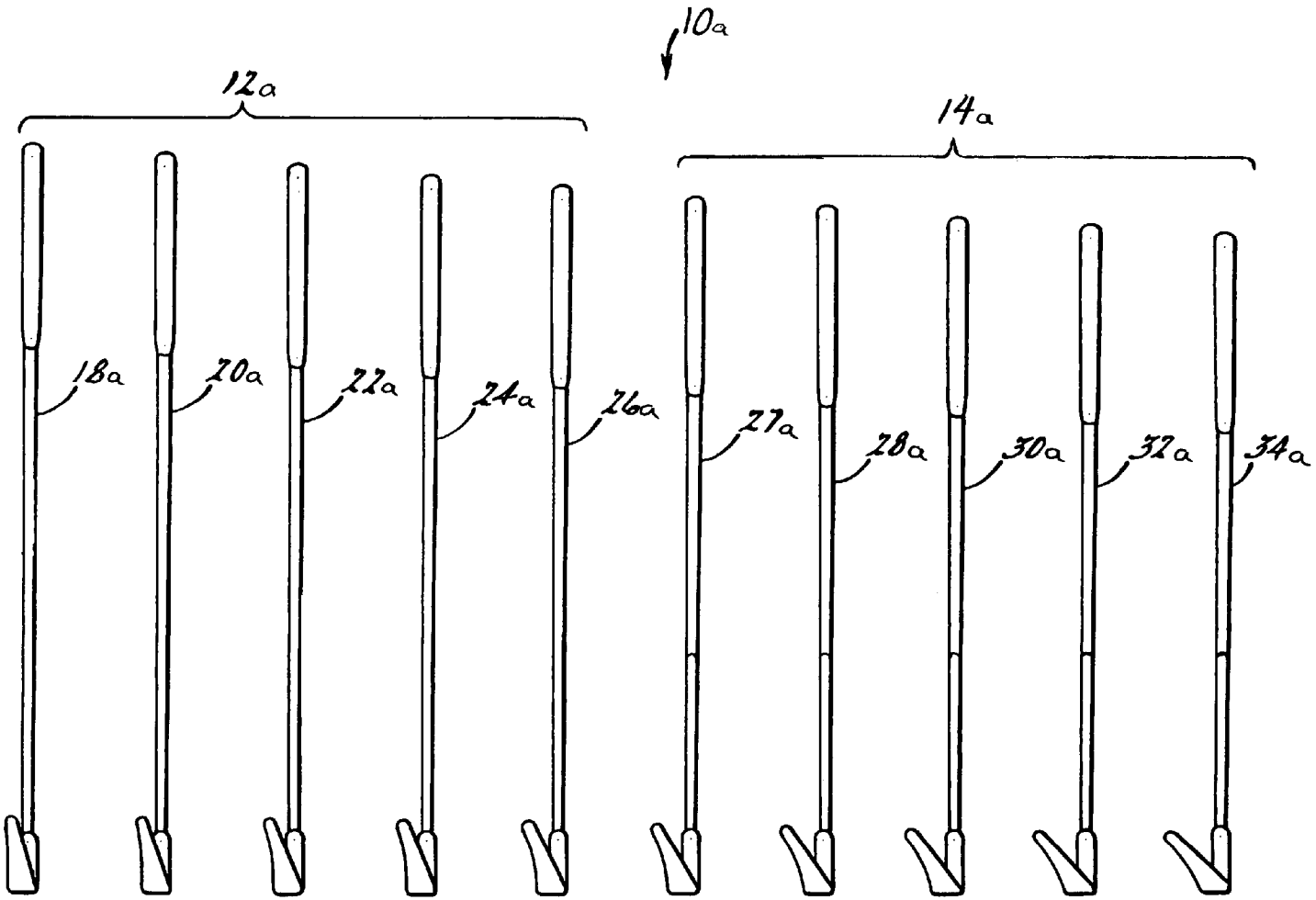
FIG. 5 illustrates an array of golf clubs forming a set having two separate shaft subsets in accordance with the teachings of the present invention.
Figure 9:
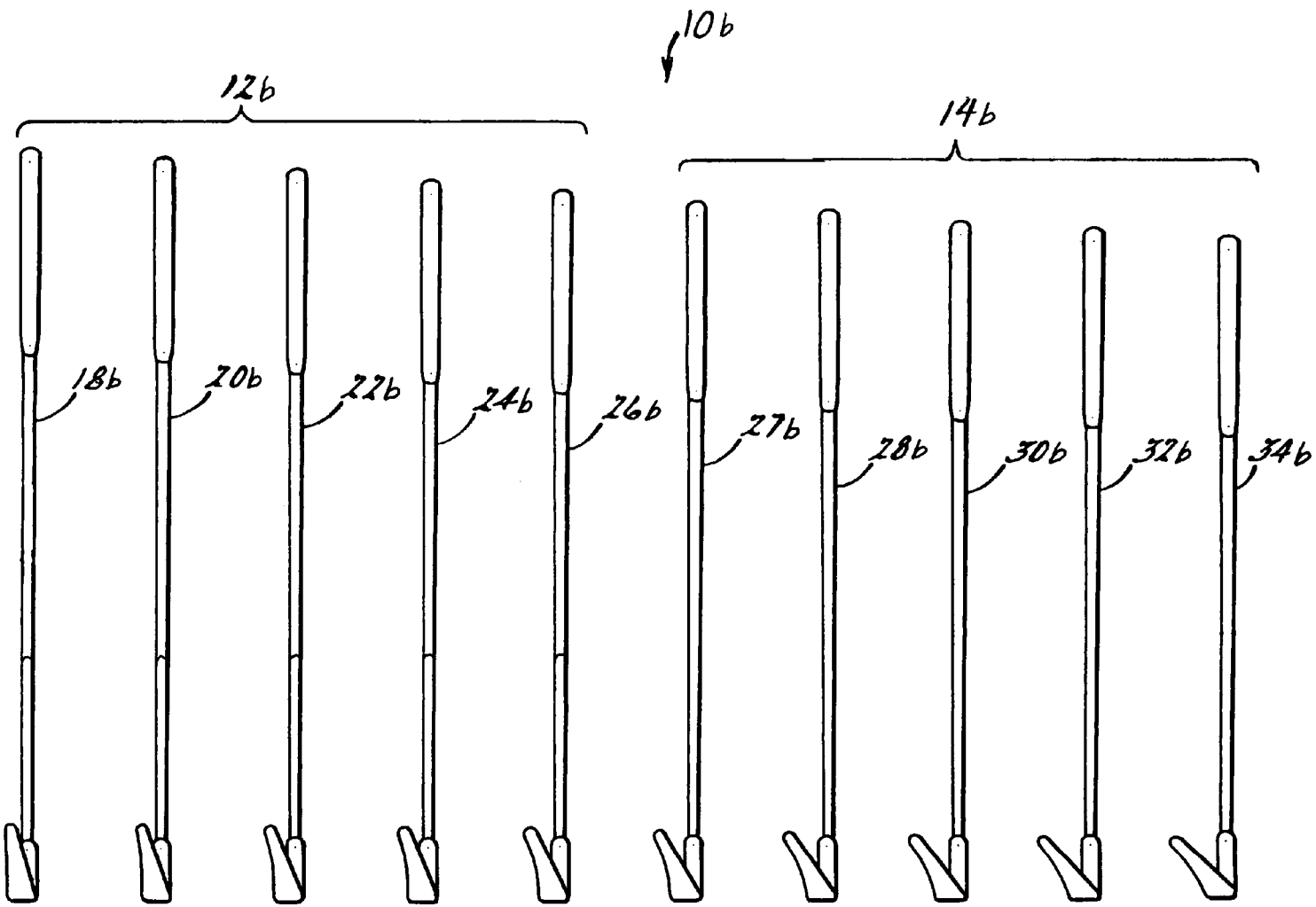

Turning now to FIG. 5, an alternate embodiment of the present invention is illustrated. This embodiment includes a golf club set 10*a* having a first shaft subset 12*a* and a second shaft subset 14*a*. The first shaft subset 12*a* includes shafts formed entirely of composite such as graphite. The second shaft subset 14*a* includes shafts formed of composite/metal combinations such as graphite butt sections coupled to steel tips.

The first shaft subset 12*a* preferably includes the long to middle iron regime. For example, the first shaft subset 12*a* may include any one or more of the one iron 18*a*, two iron 20*a*, three iron 22*a*, four iron 24*a*, and/or five iron 26*a*. The second shaft subset 14*a* preferably includes the middle to short iron regime. For example, the second shaft subset 14*a* may include any one or more of the six iron 27*a*, seven iron 28*a*, eight iron 30*a*, nine iron 32*a*, and/or wedge 34*a*. Although only one wedge 34*a* is illustrated, it should be appreciated that any number of wedges could be included in the second shaft subset.

As stated above with respect to the first embodiment, the second shaft subset 14*a* is illustrated as including tip sections which are substantially equal in length. Alternatively, the tip sections may proportionately decrease as the overall shaft lengths decrease. However, in the presently preferred embodiment, the tip section length is inversely proportional to the overall shaft length. As such, as the overall shaft length decreases, the proportionate length of the tip section increases. This provides greater torsional resistance (and therefore greater accuracy and feel) in each consecutively shorter club where the desire for accuracy increases.

The first and second shaft subsets 12*a* and 14*a* may be delineated from one another according to the type of club (e.g., one iron, two iron, etc.) included therein. The subsets may also be delineated from one another by the length of the shafts and/or the lofts of the club heads. These dimensions may be set in absolute terms and/or relative terms.

Based upon the above table, the first shaft subset 12*a* may be defined as including shafts for the 1, 2, 3, 4 and 5 irons. The first shaft subset 12*a* may alternatively be defined as including shafts having a length within a first predetermined range such as 36.5 to 40 inches. The first shaft subset 12*a* may further be defined as including shafts with a club head loft within a first predetermined range such as such as 15 to 28 degrees.

The second shaft subset 14*a* may be defined as including shafts for the 6, 7, 8, 9 and wedge irons. The second shaft subset 14*a* may alternatively be defined as including shafts having a length within a second predetermined range such as 35 to 38 inches. The second shaft subset 14*a* may further be defined as including shafts with a club head loft within a second predetermined range such as 28 to 60 degrees.

In relative terms, the first predetermined range may be defined as including shafts having a length between X and Y inches or a loft between A and B degrees. The second predetermined range may be defined as including shafts having a length between $X–Z_1$ and $Y–Z_2$ inches or a loft between $A+C_1$ and $B+C_2$ degrees, wherein, for example $Z_1=2$, $Z_2=2.5$, $C_1=13$, and $C_2=30$.

As can be seen, the first and second predetermined ranges are different but may overlap. The first predetermined length range is greater than the second predetermined length range. In contrast, the first predetermined loft range is less than the second predetermined loft range.

Turning now to FIG. 6, another alternate embodiment of the present invention is illustrated. This embodiment includes a golf club set 10*b* having a first shaft subset 12*b* and a second shaft subset 14*b*. The first shaft subset 12*b* includes shafts formed of composite/metal combinations such as graphite butt sections coupled to steel tips. The second shaft subset 14*b* includes shafts formed entirely of metal such as steel.

The first shaft subset 12*b* preferably includes the long to middle iron regime. For example, the first shaft subset 12*b* may include any one or more of the one iron 18*b*, two iron 20*b*, three iron 22*b*, four iron 24*b*, and/or five iron 26*b*. The second shaft subset 14*b* preferably includes the middle to short iron regime. For example, the second shaft subset 14*b* may include any one or more of the six iron 27*b*, seven iron 28*b*, eight iron 30*b*, nine iron 32*b*, and/or wedge 34*b*. Although only one wedge 34*b* is illustrated, it should be appreciated that any number of wedges could be included in the second shaft subset.

The first shaft subset 12*b* is illustrated as including tip sections which are substantially equal in length. Alternatively, the tip sections may proportionately decrease as the overall shaft lengths decrease. However, in the presently preferred embodiment, the tip section length is inversely proportional to the overall shaft length. As such, as the overall shaft length decreases, the proportionate length of the tip section increases. This provides greater torsional resistance (and therefore greater accuracy and feel) in each consecutively shorter club where the desire for accuracy increases.

The first and second shaft subsets 12*b* and 14*b* may be delineated from one another according to the type of club (e.g., one iron, two iron, etc.) included therein. The subsets may also be delineated from one another by the length of the shafts and/or the lofts of the club heads. These dimensions may be set in absolute terms and/or relative terms.

Based upon the above table, the first shaft subset 12*b* may be defined as including shafts for the 1, 2, 3, 4 and 5 irons. The first shaft subset 12*b* may alternatively be defined as including shafts having a length within a first predetermined range such as 36.5 to 40 inches. The first shaft subset 12*b* may further be defined as including shafts with a club head loft within a first predetermined range such as such as 15 to 28 degrees.

The second shaft subset 14*b* may be defined as including shafts for the 6, 7, 8, 9 and wedge irons. The second shaft subset 14*b* may alternatively be defined as including shafts having a length within a second predetermined range such as 35 to 38 inches. The second shaft subset 14*b* may further be defined as including shafts with a club head loft within a second predetermined range such as 28 to 60 degrees.

In relative terms, the first predetermined range may be defined as including shafts having a length between X and Y inches or a loft between A and B degrees. The second predetermined range may be defined as including shafts having a length between $X-Z_1$ and $Y-Z_2$ inches or a loft between $A+C_1$ and $B+C_2$ degrees, wherein, for example $Z_1=2$, $Z_2=2.5$, $C_1=13$, and $C_2=30$.

As can be seen, the first and second predetermined ranges are different but may overlap. The first predetermined length range is greater than the second predetermined length range. In contrast, the first predetermined loft range is less than the second predetermined loft range.

Thus, a hybrid golf club shaft set is provided. The set maximizes the desired shaft characteristics in each subset regime and across the entire set. In one embodiment, the long iron regime comprises shafts are made entirely of composite such that they are light and flexible for maximizing distance. The short iron regime comprises shafts made entirely of metal such that they are heavy and torsionally stiff for maximizing accuracy. The middle iron regime comprises shafts made of composite/metal combinations such that they blend weight, flexibility and torsional stiffness to balance distance with accuracy. In the alternate embodiments, only two of the three types of shaft subsets are employed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A set of golf club shafts adapted to connect to iron club heads, the set comprising:

a first shaft subset consisting of composite/metal combination shafts adapted to connect to iron club heads; and a second shaft subset selected from the group including:

first shafts consisting of composite shafts adapted to connect to iron club heads; and second shafts consisting of metal shafts adapted to connect to iron club heads, wherein:

one of said first and second shaft subsets have lengths within a first predetermined range; and another of said first and second shaft subsets have lengths within a second predetermined range;

said first and second predetermined ranges being different; and wherein:

said one of said first and second shaft subsets includes at least one of a 1 iron, a 2 iron, a 3 iron, a 4 iron, and a 5 iron; and said another of said first and second shaft subsets includes at least one of a 6 iron, a 7 iron, an 8 iron, a 9 iron, and a wedge.

2. The set of golf club shafts of claim 1 wherein:

said one of said first and second shaft subsets includes said 3 iron, said 4 iron and said 5 iron; and said another of said first and second shaft subsets includes said 6 iron, said 7 iron, said 8 iron, said 9 iron, and said wedge.

3. A set of golf club irons comprising:

a plurality of iron club heads having varying lofts; and a plurality of shafts individually coupled to said plurality of iron club heads, said plurality of shafts including:

a first shaft subset consisting of composite/metal combination shafts; and a second shaft subset consisting of one of composite shafts and metal shafts.

4. The set of golf club irons of claim 3 wherein:

one of said first and second shaft subsets are coupled to club heads having lofts within a first predetermined range; and another of said first and second shaft subsets are coupled to club heads having lofts within a second predetermined range;

said first and second predetermined ranges being different.

5. A set of golf club irons comprising:

a first subset including a 3 iron, a 4 iron, and a 5 iron; and a second subset including a 6 iron, a 7 irons an 8 iron, a 9 iron, and a wedge;

wherein:

all shafts in the first subset consist of one of composite shafts, composite/metal combination shafts, and metal shafts; and all shafts in the second subset consist of another one of composite shafts, composite/metal combination shafts, and metal shafts;

such that the shafts in the first subset are different from the shafts in the second subset.

6. The set of golf club irons of claim 5 wherein:

said first subset consists of composite shafts; and said second subset consists of composite/metal shafts.

7. The set of golf club irons of claim 5 wherein:

said first subset consists of composite/metal shafts; and said second subset consists of metal shafts.

* * * * *